US007134917B2

(12) United States Patent
Deng et al.

(10) Patent No.: US 7,134,917 B2
(45) Date of Patent: Nov. 14, 2006

(54) MODULAR CONNECTOR

(75) Inventors: Wen Feng Deng, Kunsan (CN); Qin Wan, Kunsan (CN); Li-Chun Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/982,523

(22) Filed: Nov. 4, 2004

(65) Prior Publication Data

US 2005/0101194 A1 May 12, 2005

(30) Foreign Application Priority Data

Nov. 11, 2003 (CN) ..... 2003 2 0110827

(51) Int. Cl.
*H01R 24/00* (2006.01)

(52) U.S. Cl. ..... 439/676; 439/941

(58) Field of Classification Search ..... 439/676, 439/941, 344, 638, 620
See application file for complete search history.

(56) References Cited

U.S. PATENT DOCUMENTS 5,456,619 A 10/1995 Belopolsky et al.
6,280,256 B1 * 8/2001 Belopolsky et al. ..... 439/676

* cited by examiner

*Primary Examiner*—Javaid H. Nasri
(74) *Attorney, Agent, or Firm*—Wei Te Chung

(57) ABSTRACT

A modular connector (100) includes an insulative housing (1) defining a chamber (10). A terminal module insert (3) is fixedly received in the chamber and defines a plurality of passageways (330) therein. A plurality of terminals (34) are received in the passageways of the insert. Each terminal includes a mounting end (341), a fixing portion (342) engaging with a corresponding passageway of the insert and a mating end (344) downwardly and rearwardly extending from the fixing portion for engaging with a contact of a mating connector in a front-to-rear direction. The terminals have positioning portions at the fixing portions. The positioning portions are oriented perpendicularly to the front-to-rear direction.

2 Claims, 5 Drawing Sheets

MODULAR CONNECTOR

BACKGROUND OF THE INVENTION

1. Field of the Invention

The present invention relates to an electrical connector and more particularly, to a modular connector for coupling a number of modular plugs to a printed circuit board.

2. Description of the Related Art

RJ modular connectors have been widely used to transmit voice and data in the telephone industry and in telecommunication system since they were firstly created. A so-called RJ45 modular connector has been widely used in the network system. Under some circumstances, the modular connector is directly mounted on a printed circuit board to couple with one or a plurality of mating plugs. A known type of modular connector is disclosed in U.S. Pat. No. 5,456,619 issued to Belopolsky on Oct. 10, 1995. The Belopolsky modular connector includes an insulative housing and an elongated insert inserted into the housing. The insert is L-shaped and includes an upright base portion and an upper portion. A plurality of linear grooves are defined in the upper portion for receiving a plurality of conductive wires. Each wire includes a vertical lead fixed in the base portion, a lateral section extending horizontally in the grooves and a downwardly and rearwardly contacting section being bent from the lateral section for electrically connecting with a contact terminal of the mating modular plug. An ultrasonically welded crossband is provided at the upper portion perpendicularly to the linear grooves and lies over parts of grooves for retaining the wires in position.

However, the crossband only effectively prevents the wires from movement upwardly and downwardly. In fact, the linear lateral sections of the wires are inclined to slide forwardly and rearwardly within corresponding linear grooves. Therefore, the wires cannot be steadily fixed in position in the housing so as to fail to be steadily engaged with the contact terminals of the mating plug. In addition, it should be recognized that adding the ultrasonically welded crossband to retain the wires in position inherently increases production cost.

Hence, an improved modular connector is required to overcome the disadvantages of the prior art.

BRIEF SUMMARY OF THE INVENTION

Accordingly, a primary object of the present invention is to provide a compact modular connector which is capable of reliably and electrically connecting with a mating plug.

To fulfill the above-mentioned objects, according to a preferred embodiment of the present invention, a modular connector includes an insulative housing including a top wall, a bottom wall, a rear wall and opposite side walls cooperatively defining a chamber therebetween. A terminal module insert is fixedly received in the chamber and defines a plurality of passageways therein. A plurality of terminals are received in the passageways of the insert. Each terminal includes a mounting end, a fixing portion engaging with a corresponding passageway of the insert and a mating end downwardly and rearwardly extending from the fixing portion for engaging with a contact of the mating plug in a front-to-rear direction. The terminals have positioning portions at the fixing portion. The positioning portions perpendicular to a front-to-rear direction of engaging/disengaging with/from the mating connector.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
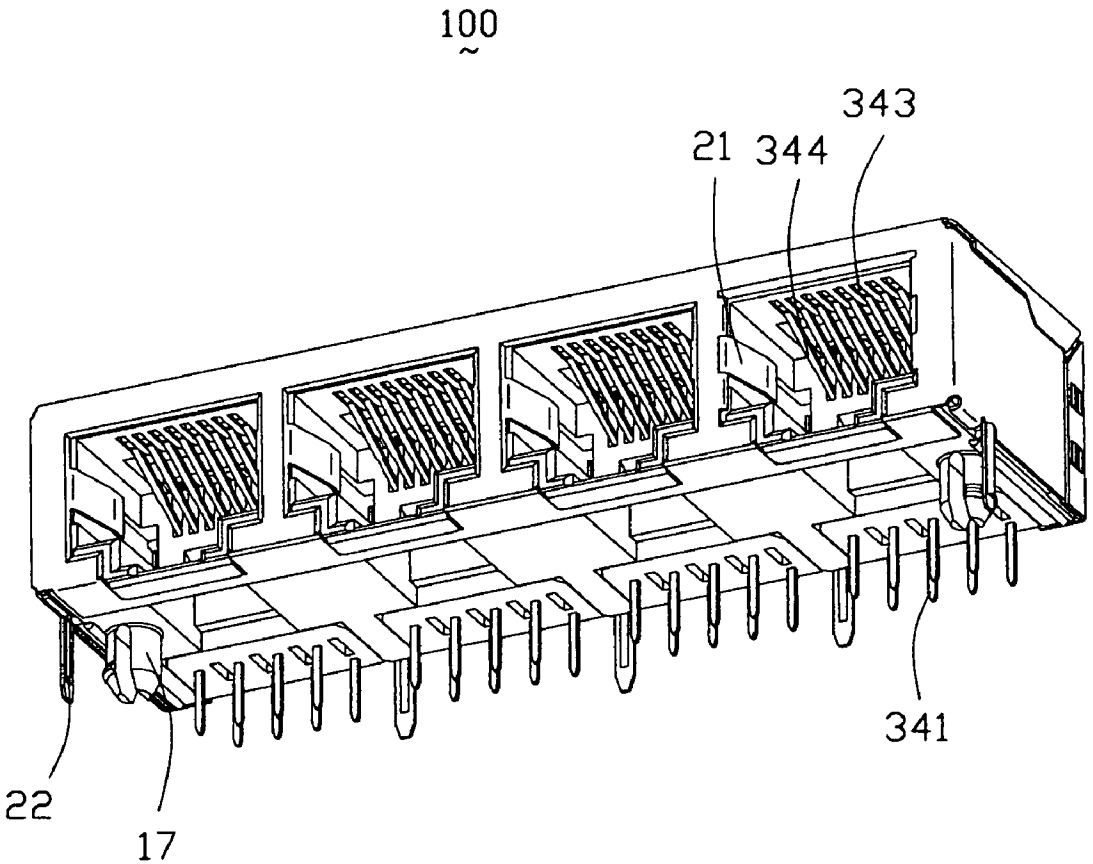
FIG. 1 is a perspective view of a modular connector according to the present invention.
Figure 2:
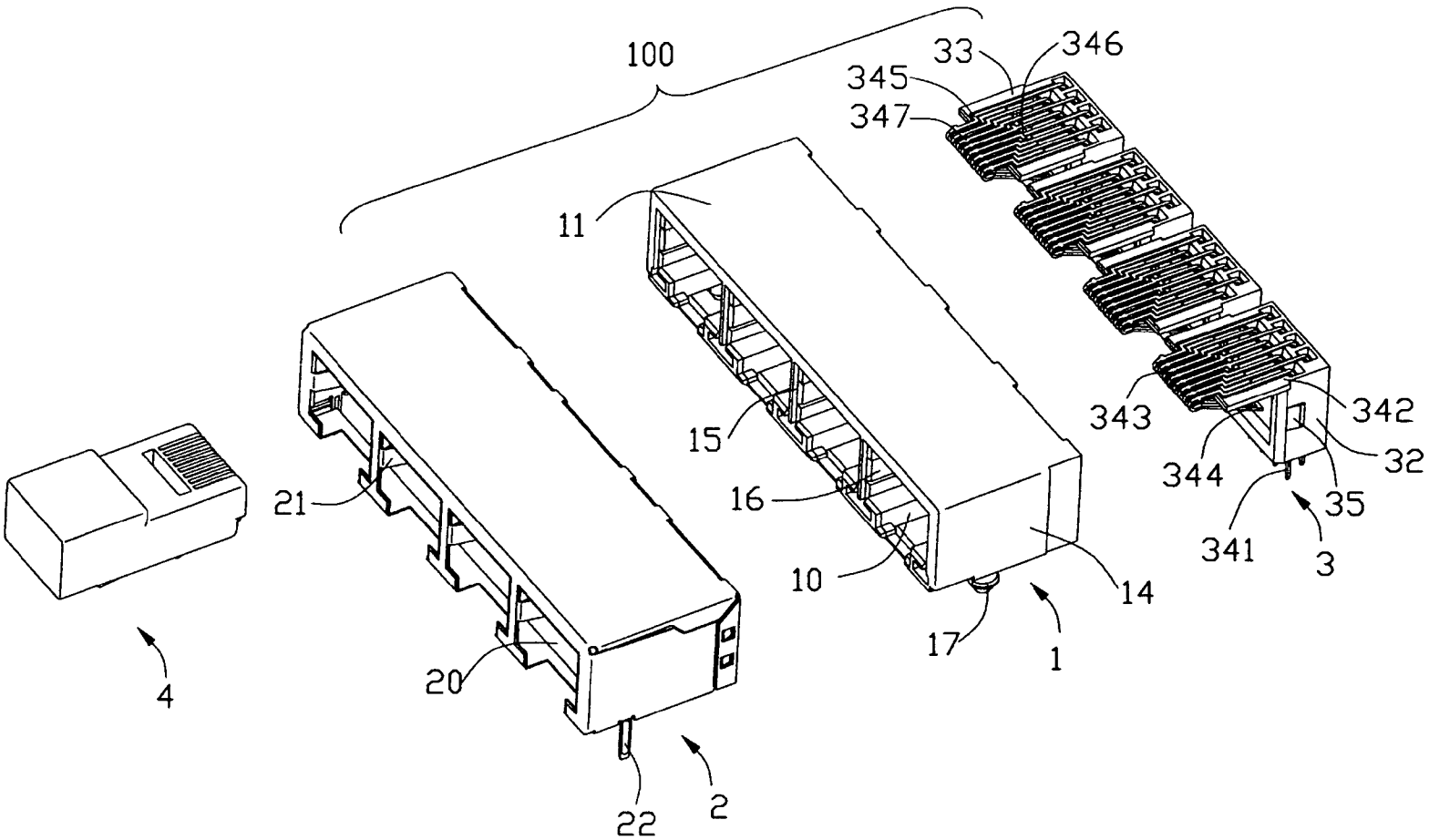
FIG. 2 is an exploded view of FIG. 1, wherein a mating plug is provided.

Referring to the drawings in greater detail, and in particular to FIGS. 1 and 2, a side-by-side modular connector 100 according to the present invention includes an insulative housing 1, an Electro Magnetic Interference (EMI) shield 2 assembled to the housing 1 and four terminal module inserts 3 fixedly received in the housing 1.

Figure 3:
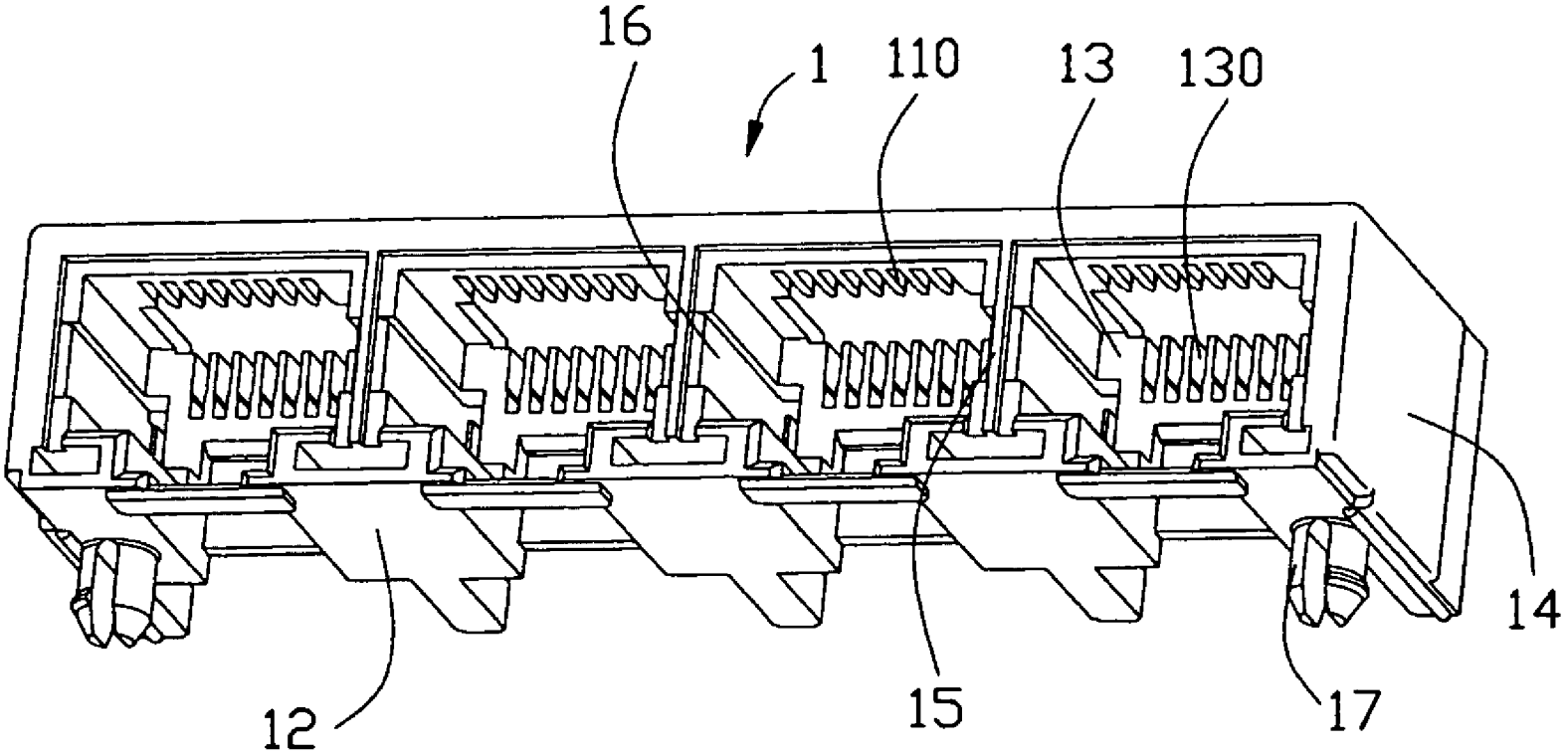
FIG. 3 is a perspective view of an insulative housing of the modular connector.

Referring to the drawings in greater detail, and in particular to FIG. 3, The housing 1 is of a substantially rectangular-shaped configuration and includes a top wall 11, a bottom wall 12, a rear wall 13 and opposite side walls 14. The housing 1 has three partitions 15 cooperatively define four chambers 10 arranged in side-by-side and parallel relationship. Each chamber 10 comprises a plug receiving space at a front portion thereof for mating with a mating plug 4 (shown in FIG. 2) and an insert receiving space at a rear portion thereof communicating with the plug receiving space for receiving the insert 3. Each chamber 10 has a cutout (not labeled) at a rear portion of the top wall 11. A plurality of horizontal locating grooves 110 are defined in a front portion of the top wall 11 and communicate with a front margin of the cutout. A plurality of vertical retention grooves 130 are defined at an upper portion of the rear wall 13 with upper ends communicating with the cutout. A pair of horizontal channels 16 are defined in opposite inner surfaces of side walls of each chamber 10. The housing 1 has a pair of mounting posts 17 symmetrically extending downwardly from bottom edges of opposite side walls 14.

The EMI shield 2 is shaped to enclose the housing 1 and defines four openings 20 corresponding to the chambers 10 of the housing 1 for receiving the mating plugs 4. A pair of horizontal resilient arms 21 extend rearwardly from a front wall of the shield 2 into opposite laterals of a corresponding opening 20. The resilient arms 21 are received in the channels 16 of the housing 1 to assemble the shield 2 to the housing 1. A plurality of mounting feet 22 are provided by stamping and project downwardly from bottom edges of opposite side plates and a rear plate of the shield. The mounting feet 22 and the mounting posts 18 are provided for securing the modular connector 100 to a printed circuit board (PCB, not shown).

Figure 4:
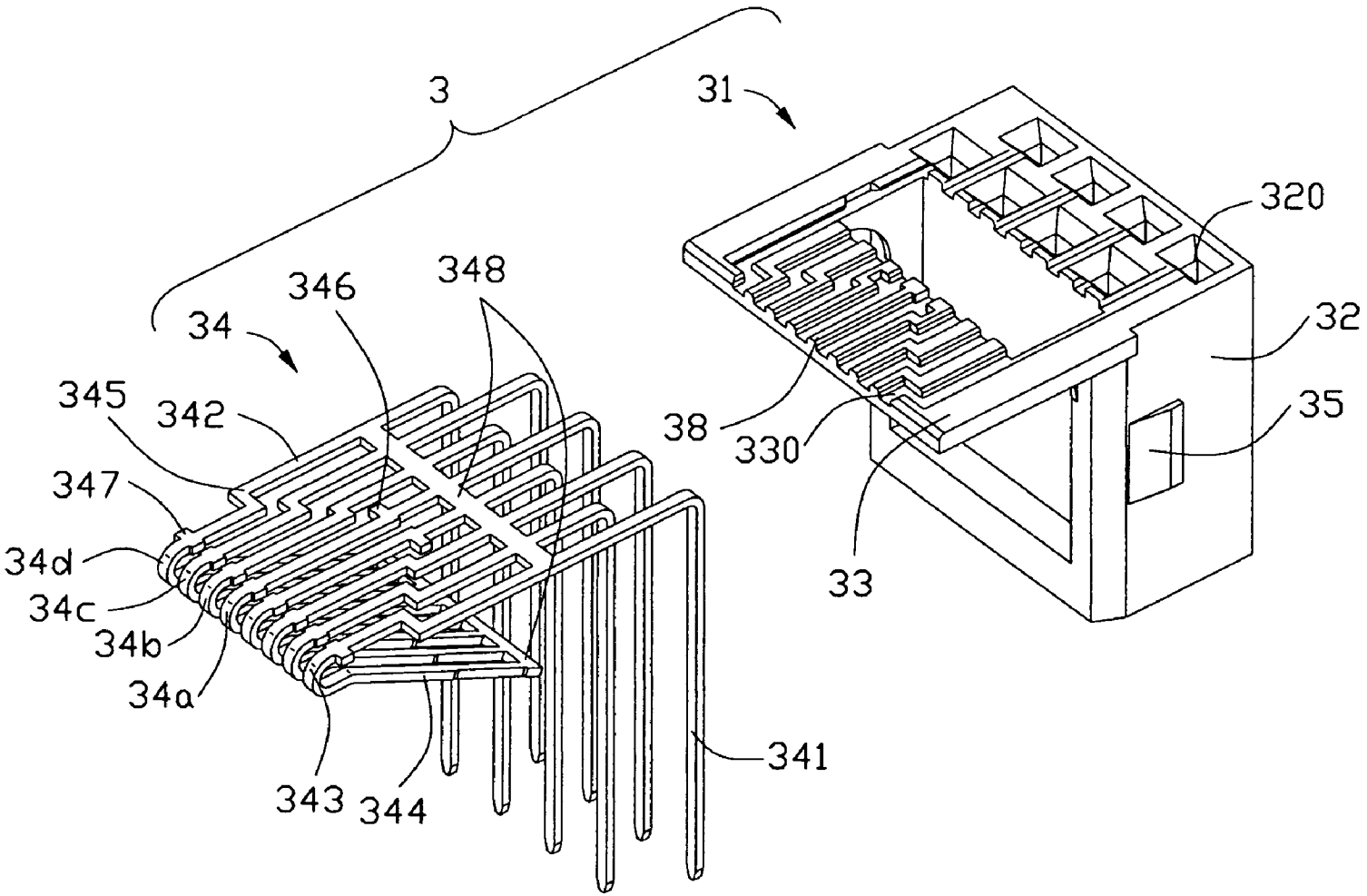
FIG. 4 is an exploded view of a terminal module insert of the modular connector.
Figure 5:
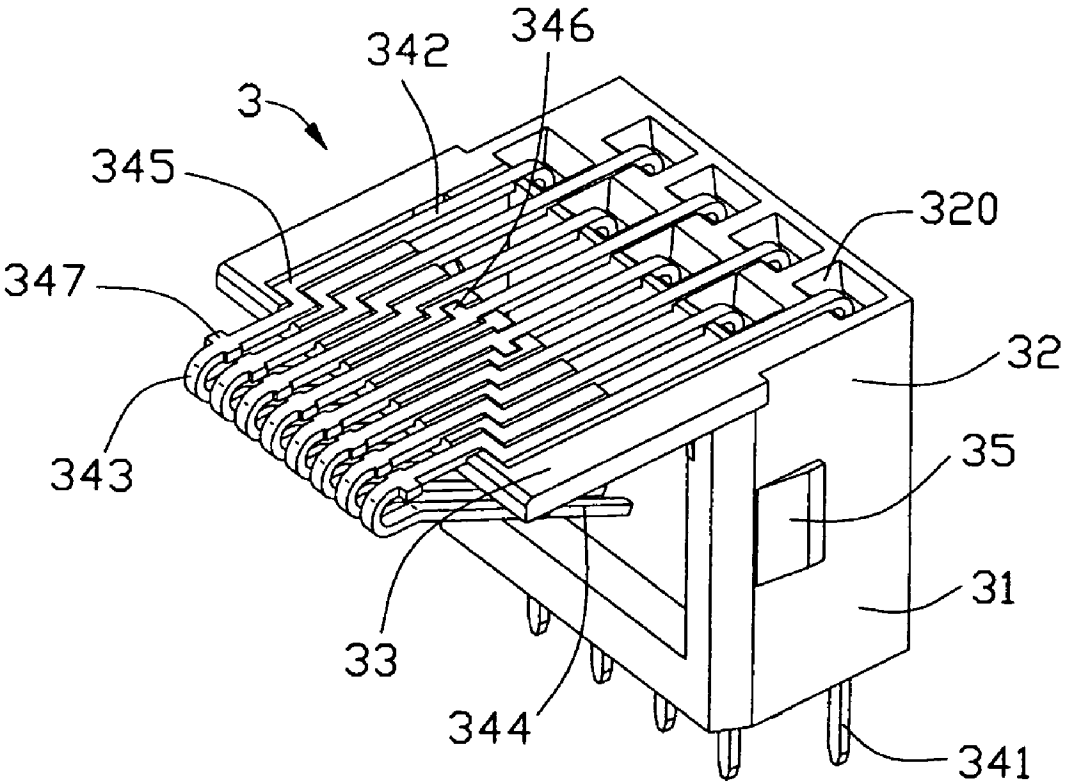
FIG. 5 is an assembled view of FIG. 4.

Referring to the drawings in greater detail, and in particular to FIGS. 4 and 5, each terminal module insert 3 has a generally L-shaped insulative casing 31 and eight conductive terminals 34 received in the casing 31. The L-shaped casing 31 includes a vertical body 32 and a horizontal plate 33. The vertical body 32 defines two rows of eight vertical holes 320 therethrough. The holes 320 in different rows have an alternating relationship. A pair of locking members 35 are formed on opposite side walls of the vertical body 32 for being fixedly mounted the assembly insert 3 into corresponding chamber 10 of the housing 1, respectively. The horizontal plate 33 is formed with seven serpentine spacers 38 to define eight zigzag terminal passageways 330, which will be discussed later. The eight terminals 34 are stamped and formed of sheet metal material. Each single terminal 34 has a fixing portion 342, a mounting end 341 extending from a rear end of the fixing portion 341, a generally U-shaped jointing portion 343 extending from opposite front end of the fixing portion 342 and a mating end 344 downwardly and rearwardly extending from the jointing portion 343. The mounting ends 341 are generally bent to a right angle relative to the fixing portions 342 and the mounting ends 342 position in different rows corresponding to the alternating relationship vertical holes 320 of the casing 31. The mating ends 344 are generally bent to a sharp angle relative to the fixing portions 342 and still has a slightly bend relative to the jointing portions 343. Each terminal 34 has a pair of locating tabs 347 at a front section of the fixing portion 342 for engaging with a corresponding locating groove 110 of the housing 1. The terminals further has a pair of carriers 348 at the fixing portion 342 and the mating ends 344 for keeping the eight terminals 34 as a whole before be assembled to the casing 31.

As seen most clearly in FIG. 4, the eight terminals 34 symmetrically position as four pairs. In order to describe clarify, the four pairs of terminals 34 are generally named 34*a*, 34*b*, 34*c* and 34*d* from midst to two sides. The terminals 34 have positioning portions 345 horizontally and inwardly bent on the way from the rear portions to the front portions so that the interval of rear portions of the terminals 34 is larger than that of the front portions of the terminals 34. The four pairs of terminals 34*a*, 34*b*, 34*c* and 34*d* have four pairs horizontally and inwardly positioning portions 345 aligning in parallel and in staggered manner. In the present embodiment, the positioning portions 345 of the terminals 34 take turns to position from midst to two sides, whereby each terminal is of a generally Z-shaped configuration which is different from each other. Especially, the pair of terminals 34*a* further forms a pair of protrusions 346 adjacent to the positioning portions 345 of the terminals 34*a* and extending outwardly to each other. Corresponding to the terminals 34, each passageway 330 of the casing 31 has the same configuration to a corresponding terminal 34 for securely retaining the terminal 34 in position.

Referring to FIGS. 1 to 5, in assembly, first, the eight terminals 34 are mounted in the casing 31. The carriers 348 of the terminals 34 are removed away. The mounting ends 342 of the terminals 34 insert into the alternating relationship vertical holes 320 of the casing 31. The fixing portions 341 of the terminals 34 are received in corresponding passageways 330. The locating tabs 347 of the terminals 34 are forwardly exposed beyond the horizontal plate 33 of the casing 31. The mating ends 344 of the terminals 34 locate blow the horizontal plate 33. Second, the casing 31 together with the terminals 34 mounted therein is inserted into corresponding chamber 10 of the housing 1. The locking members 35 of the casing 31 lock with inner surfaces of the chamber 10. The locating tabs 347 of the terminals 34 engage with the locating grooves 110 of the housing 1. The distal ends of corresponding mating ends 344 are received in the retention grooves 130 of the housing 1. Thereafter, the eight terminals 34 are firmly fixed to the insert 3 within the housing 1.

It is note that the terminals 34 are not molded integrally with the casing 31 but are stamped separately. Such terminals 34 are easy to manufactured and easily assembled. And it is should be noted that each terminal 34 employs the slightly bend between the jointing portion 343 and the mating end 344, the slightly bend provide the mating end 344 with enough flexibility, ensuring the mating end 344 robustly come to normal position, thereby avoiding damage of the terminal 34. The modular connector 100 of the present invention, therefore, has a long life-span.

It is also noted that the positioning portion 345 of the terminals 34 are inward and generally horizontal. That is to say, the positioning portions 345 are in the rough perpendicular to a front-to-rear direction of engaging/disengaging with/from the mating plug 4. When the terminals 34 are received in the casing 31, the fixing portions 345 interferentially engage with the spacers 38 of the casing 31 so as to prevent a forwardly and rearwardly movement of the terminals 34. When the terminals 34 is mounted in the casing 31 and is sandwiched within the housing 1, the locating tabs 347 of the terminals 34 engage with the locating grooves 110 of the housing 1 so as to prevent an upwardly and downwardly movement of the terminals 34. Therefore, the terminals 34 cannot be move in any direction so as to steadily retain in position.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular connector adapted for being mounting on a printed circuit board and mating with a mating connector, comprising:

an insulative housing including a top wall, a bottom wall having a bottom face adapted for being mounting to the printed circuit board, a rear wall and opposite side walls, the top, bottom, rear and opposite side walls cooperatively defining a chamber therein;

a terminal module insert fixedly received in the chamber, the insert including a casing and a plurality of terminals mounted in the casing, the casing defining a plurality of passageways and a plurality of vertical holes, each terminal including a mourning end for being mounted in the vertical hole, a fixing portion for being received in the passageway and a mating end extending from the fixing portion for engaging with a contact of the mating connector in a front-to-rear direction, said fixing portions extending within a same plane, some of the terminals having positioning portions at the fixing portions, the positioning portions being oriented perpendicularly to the front-to-rear direction, the positioning portions being bent horizontally and inwardly on the way from rear to front of the fixing portions of the terminals.

2. A modular jack comprising:

an insulative housing defining a chamber therein;

a terminal module inserted into the chamber and including a casing;

a plurality of juxtaposed terminals disposed in the casing, each of said terminals defining a horizontal section including a Z-like segment to form an internal offset arrangement of said horizontal section; and the casing defining a plurality of passageways for receiving the horizontal section of the corresponding terminal, each of said passageway configured with a Z-like shape in compliance with the Z-like segment of the horizontal section of the corresponding terminal; wherein the Z-like segments of the neighboring terminals are offset from one another in the front-to-back direction, wherein said Z-like segments of the terminals are successively away from a mating face of the housing farther and farther.

* * * * *